US008162346B2

(12) United States Patent
Purdue

(10) Patent No.: US 8,162,346 B2
(45) Date of Patent: Apr. 24, 2012

(54) MOBILE CHAIR ASSEMBLY

(76) Inventor: Carole Purdue, Centreville, MD (US)

( * ) Notice: Subject to any disclaimer, the term of this patent is extended or adjusted under 35 U.S.C. 154(b) by 166 days.

(21) Appl. No.: 12/634,004

(22) Filed: Dec. 9, 2009

(65) Prior Publication Data

US 2010/0140898 A1 Jun. 10, 2010

Related U.S. Application Data

(60) Provisional application No. 61/121,026, filed on Dec. 9, 2008.

(51) Int. Cl.
*A61G 5/10* (2006.01)

(52) U.S. Cl. ..... 280/304.1

(58) Field of Classification Search ..... 280/304.1; 297/DIG. 4; 4/480; 5/81.1 HS, 81.1 R, 86.1; 224/275

See application file for complete search history.

(56) References Cited

U.S. PATENT DOCUMENTS

| | | | | |
|---|---|---|---|---|
| 838,228 | A | | 12/1906 | Williams |
| 2,612,209 | A | | 9/1952 | Alldredge et al. |
| D182,178 | S | | 2/1958 | Golden |
| 3,674,310 | A | | 7/1972 | Montagano |
| 4,268,054 | A | | 5/1981 | Twitchell et al. |
| 4,676,519 | A | | 6/1987 | Meier |
| 4,753,482 | A | | 6/1988 | Warren |
| 4,771,489 | A | * | 9/1988 | Chen et al. ..... 5/604 |
| 4,811,964 | A | | 3/1989 | Horn |
| 4,893,827 | A | | 1/1990 | Gay et al. |
| 5,020,817 | A | | 6/1991 | Leib |
| 5,088,747 | A | * | 2/1992 | Morrison et al. ..... 297/219.1 |
| 5,499,833 | A | | 3/1996 | Her et al. |
| 5,573,261 | A | | 11/1996 | Miller |
| 6,206,393 | B1 | | 3/2001 | Mascari et al. |
| 6,213,487 | B1 | | 4/2001 | Doroftei |
| 6,447,064 | B1 | | 9/2002 | Mundy et al. |
| 6,467,788 | B1 | | 10/2002 | Li et al. |
| 6,467,797 | B1 | | 10/2002 | Lofy et al. |
| 6,733,074 | B2 | | 5/2004 | Groth |
| 7,007,965 | B2 | | 3/2006 | Bernatsky et al. |
| 7,090,240 | B2 | | 8/2006 | Papac |
| 7,146,666 | B2 | | 12/2006 | Christofferson et al. |

* cited by examiner

*Primary Examiner* — Tony Winner
(74) *Attorney, Agent, or Firm* — Roger M. Rathbun

(57) ABSTRACT

A mobile chair assembly includes a pair of wheels rotatably supported by a frame, a seat assembly mounted to the frame; and a transfer board assembly movable between a first position and a second position. The transfer board assembly includes a rigid transfer board and an attachment assembly. In the first position, the rigid transfer board and the attachment assembly are disposed under the seat assembly and in the second position, the rigid transfer board extends laterally from the seat assembly. The seat assembly includes a seat support pivotable relative to the frame; and a back support pivotably attached to a back of the seat support. In a folded position, the seat support and back support form an acute angle to one another and the seat support is inclined relative to the frame.

8 Claims, 10 Drawing Sheets

MOBILE CHAIR ASSEMBLY

BACKGROUND

1. Field of the Invention

Apparatuses consistent with this invention relate generally to a mobile chair assembly for use by wheelchair dependent or disabled individuals.

2. Background of the Invention

Since nursing homes, assisted living facilities, and other long term care institutions have been in existence, there has been an ongoing challenge to improve the residents seating and positioning needs during the many hours spent out of their beds. This population spends an average of 6-10 hours per day in their chairs and is dependent on their chairs for all of their seating and mobility needs.

Standard, sling back wheelchairs have always been the primary chairs used in these environments due to their availability and low cost. However, they were never designed for prolonged sitting and have many adverse effects when used for extended hours. The sling back wheelchairs offer no comfort, no postural support, no ease of mobility, no ability to change positions, and no ease of transfers in and out of the chair.

Many new products are on the market to modify these uncomfortable chairs, for example, with various wheelchair cushions, contoured back supports, padded leg supports, and padded arm supports. However, they are very costly and frequently misused or misplaced in care facilities. The result is the use of uncomfortable, antiquated, poorly conditioned and pieced together wheelchairs for the elderly and disabled to spend their waking hours.

Prolonged sitting in a standard wheelchair results in many issues that directly affect the health, comfort, function, well-being, and dignity of the user. For example, users often fall out of their wheelchairs after multiple attempts to reposition themselves for comfort or after exhaustion from trying to stay in an upright position. Users begin to develop pressure sores from prolonged sitting. Pressure sores can form after only 1-2 hours in one position and can take up to 6 months to a year to heal. Users may also develop swallowing and respiratory problems due to poorly flexed postures. Users may become overly exhausted and are unable to participate in simple activities such as feeding, grooming, recreational activities, and social events. Users may develop contractures, limited range of motion and overall debility. Users may become unable to effectively propel their wheelchairs due to poor posture and fatigue and become dependent for all of their mobility. Legs can fall through leg rests causing skin tears or pressure sores. Individuals often have pain and discomfort from having to spend the majority of their day in uncomfortable chairs, which often results in behavior problems.

Currently, there remains a need for a manual mobility chair that has the features needed to accommodate or correct the above problems.

SUMMARY OF THE INVENTION

One exemplary aspect provides a mobile chair assembly including a frame; a pair of wheels rotatably supported by the frame; a seat assembly mounted to the frame, including a cushion; and a transfer board assembly attached to the seat assembly and movable between a first position and a second position. The transfer board assembly includes a rigid transfer board and an attachment assembly. In the first position, the rigid transfer board and the attachment assembly are disposed under the seat cushion, and in the second position, the rigid transfer board extends laterally from the seat cushion.

Another exemplary aspect provides a mobile chair assembly including a frame; a pair of wheels rotatably supported by the frame; a seat support rotatable relative to the frame; and a back support rotatably attached to a back of the seat support. The seat support and back support are movable between a folded position in which the seat support and back support form an acute angle to one another and the seat support is inclined relative to the frame and a seating position in which the seat support is substantially perpendicular to the back support.

Mobile chair assemblies of the exemplary embodiments have multiple features which, when combined, promote optimal seating and positioning function, health, safety, comfort and style for the wheelchair dependent individual using their chair for extended hours throughout the day. Exemplary embodiments improve the quality of life for any user using a wheelchair for extended periods of time by offering comfort, function, safety, postural support, portability, and improved health. The chair moves with less effort than the standard wheelchair wheel rim technique in a slow but functional pace. The combination of the walker and chair prevents falls for users who are able to walk, but have a high risk of falling.

BRIEF DESCRIPTION OF THE DRAWINGS

These and other exemplary aspects and advantages will become more readily appreciated by reference to the following detailed descriptions of exemplary embodiments and accompanying drawings, which should not be used to limit the invention in any way, in which.

DETAILED DESCRIPTION OF EXEMPLARY EMBODIMENTS

Figure 1:
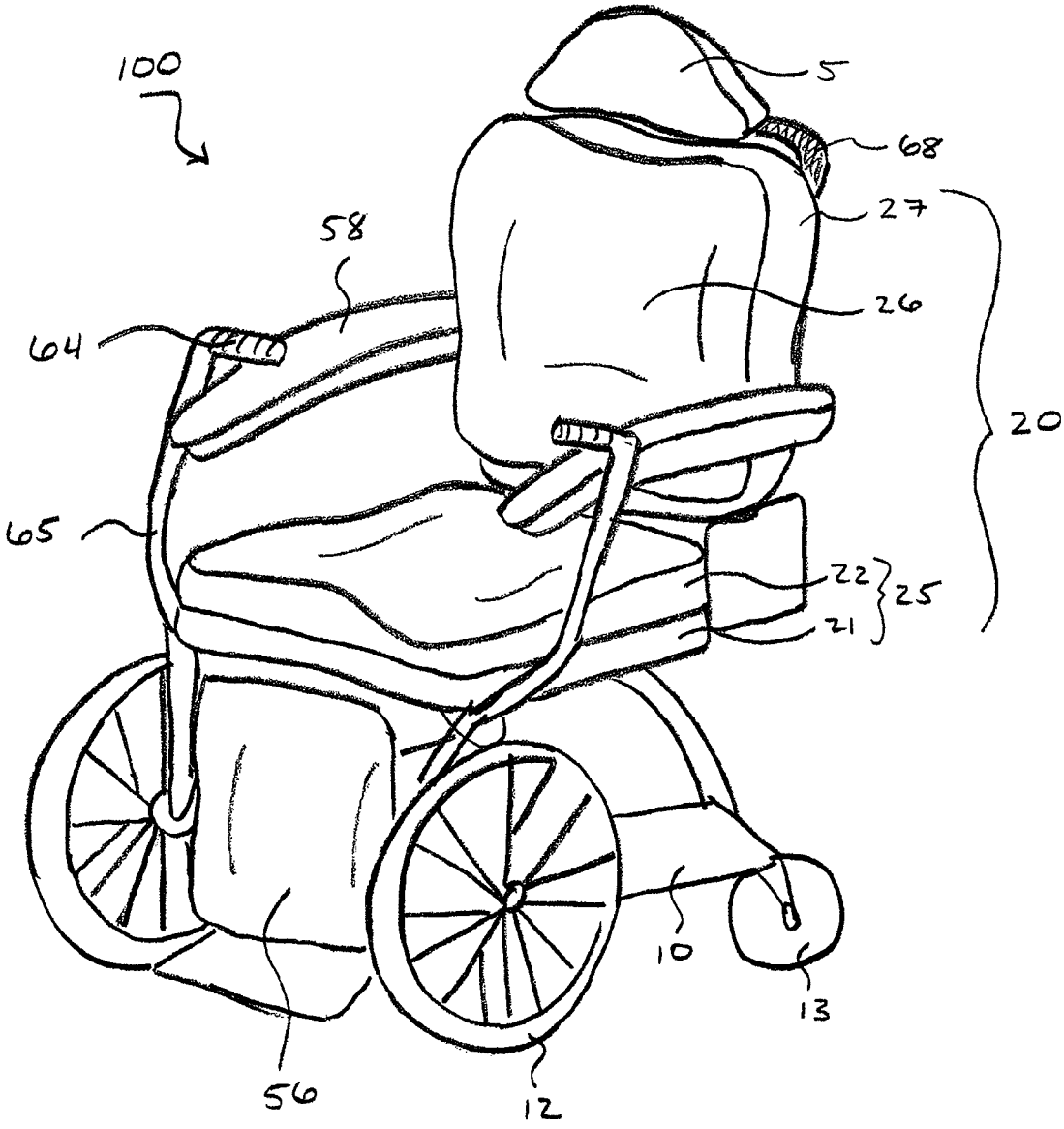
FIG. 1 is a perspective left side view of an exemplary embodiment.
Figure 2:
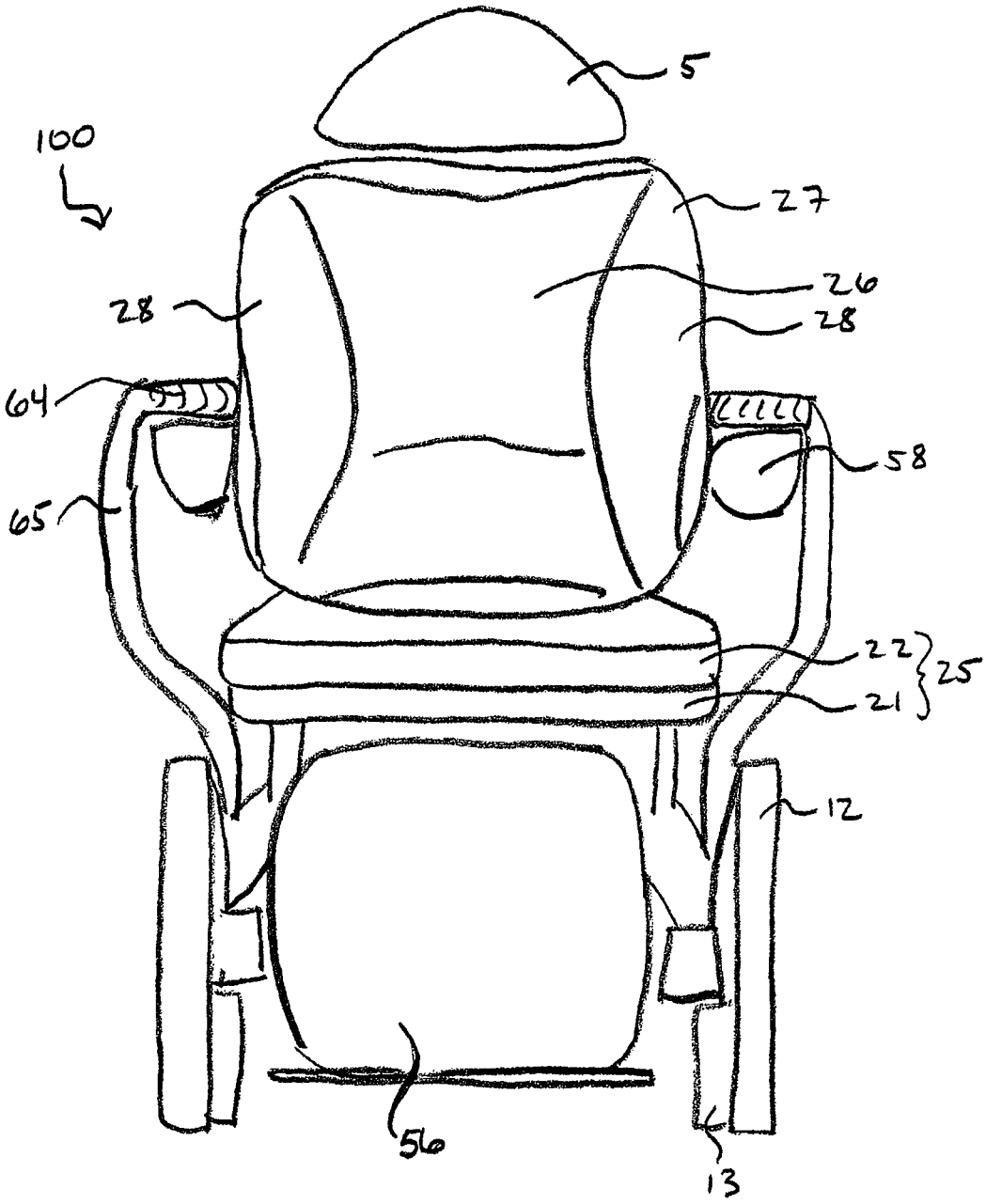
FIG. 2 is a front view of an exemplary embodiment.

As shown in FIGS. 1 and 2, according to a first exemplary embodiment, a mobile chair assembly 100 includes a frame 10, a pair of drive wheels 12 rotatably supported by the frame 10, and a seat assembly 20 mounted to the frame 10.

The seat assembly 20 includes a seat support 25 attached to the frame 10 and back support 26 pivotably attached to the seat support 25. The seat support 25 includes a seat frame 21 and a seat cushion 22. The back support includes a back cushion 27. The seat cushion 22 and the back cushion 27 include padding to relieve pressure. The back cushion 27 may include inflatable lateral supports 28 (see FIG. 2) which can be inflated or deflated as desired for lateral support of a user. Arm supports 58 are pivotably attached to the back support 26.

Figure 3A:
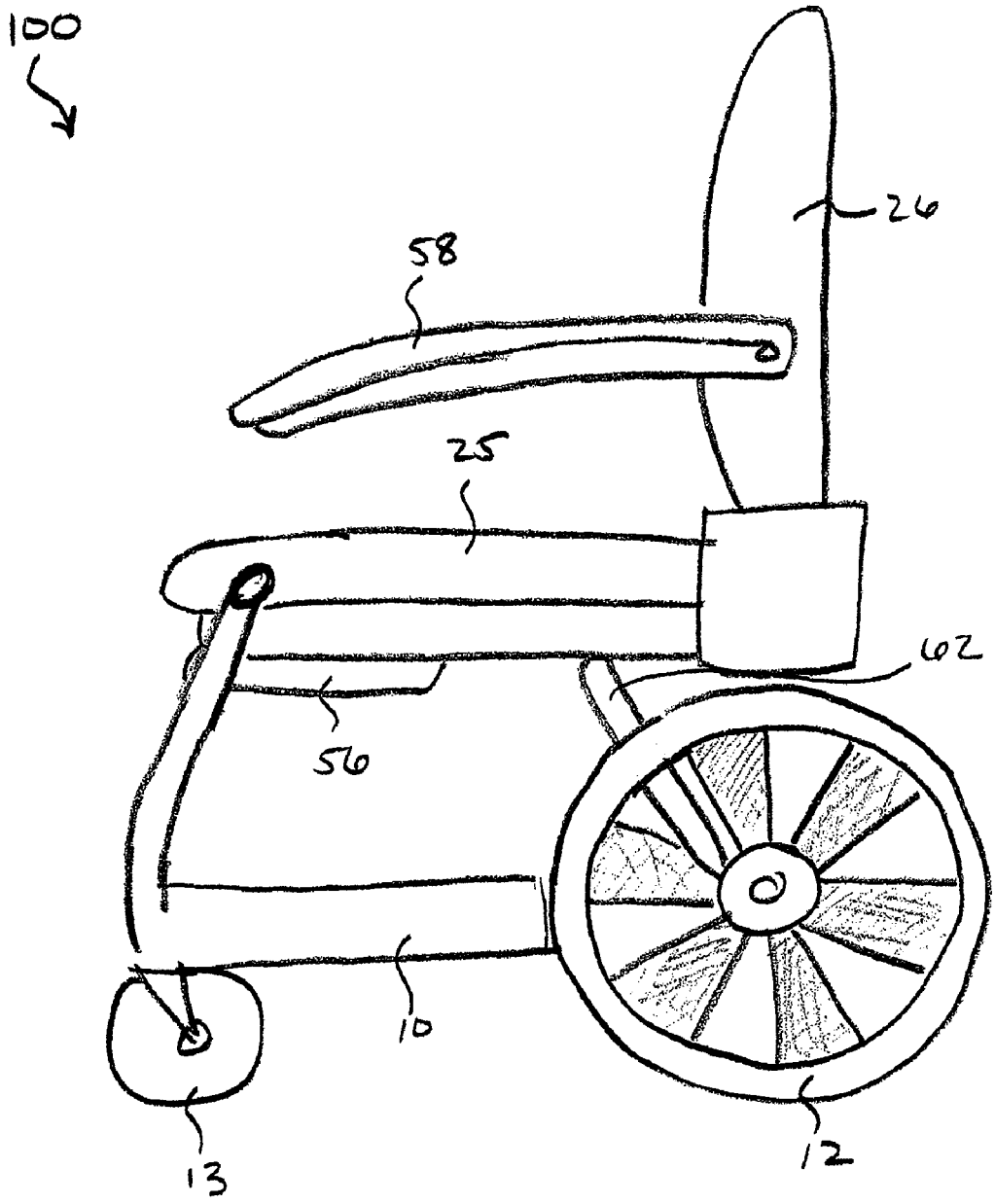
FIGS. 3A-3C are a left side views of an exemplary embodiment.
Figure 3B:
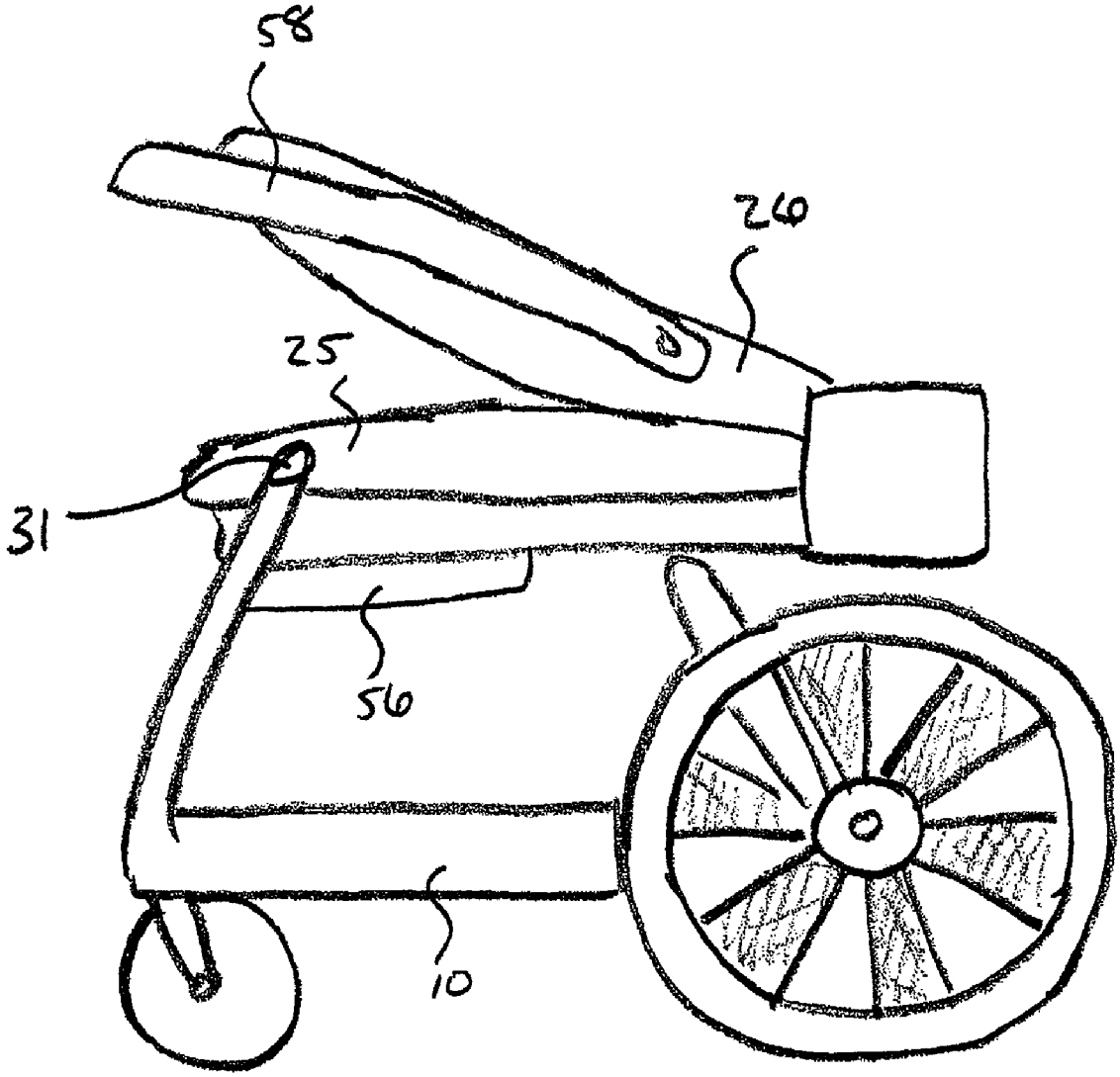
Figure 3C:
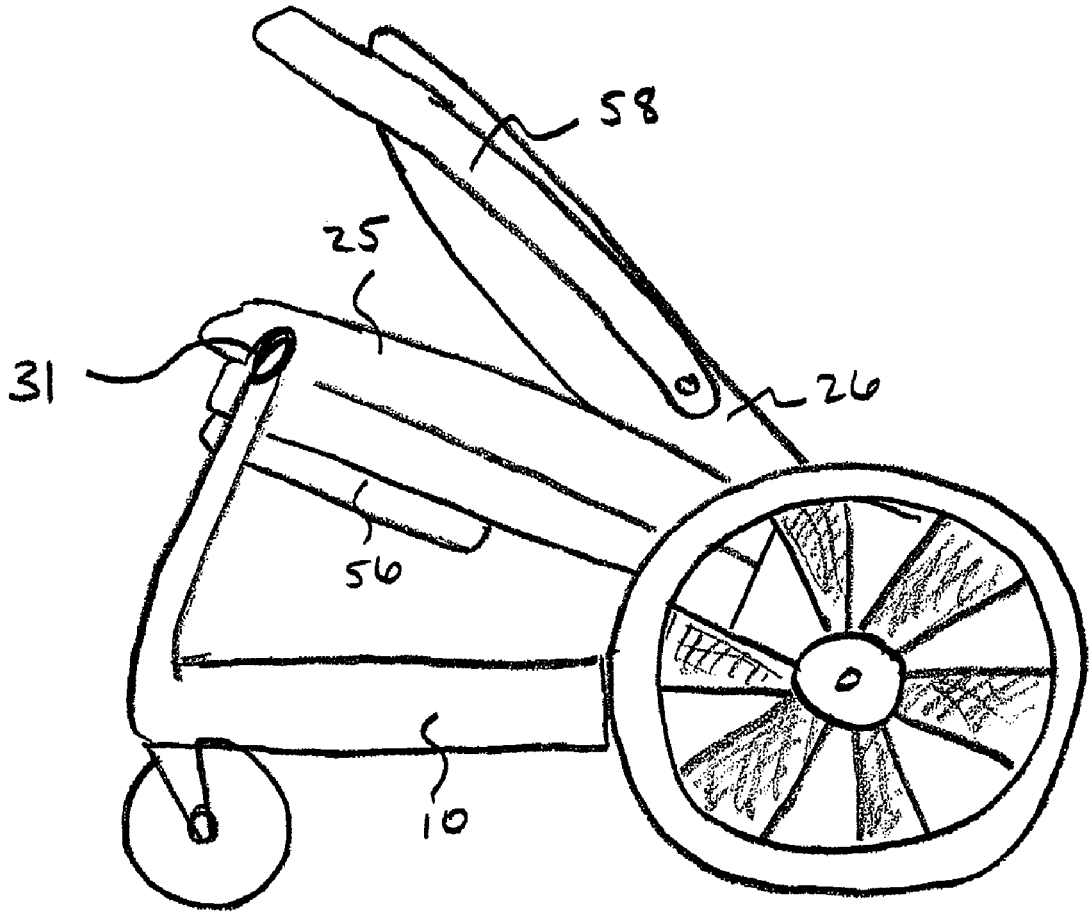

The back support 26 is pivotable relative to the seat support 25, such that the back support 26 can be tilted down onto the seat support 26 to be substantially flush with the seat support 26, as shown in FIGS. 3A-3C. The seat cushion 28 and any other cushions included on the chair may be covered with a washable, breathable, fluid resistant material so that proper hygiene and infection control can be maintained.

A head support 5 may extend upwardly from the top of the back support 26, as shown for example in FIGS. 1 and 2. The head support 5 is padded and is adjustable for optimal head and neck positioning when tilted back in a resting position.

As shown in FIGS. 1 and 2, the drive wheels 12 may be located toward the front of the chair, and a pair of auxiliary wheels 13 which have a smaller diameter than the drive wheels 12 are rotatably disposed toward the back of the chair. Alternately, as shown in FIGS. 3A-3C, the pair of drive wheels may be in the rear of the chair and the auxiliary wheels 13 may be disposed toward the front of the chair.

As shown in FIGS. 3A-3C, the chair assembly may be foldable. The seat support 25 may be pivotable relative to the frame 10 and the back support 26 may be pivotably attached to a back of the seat support 25. The seat support 25 and back support 26 are movable between a folded position shown in FIG. 3C and a seating position shown in FIG. 3A.

As shown in FIG. 1, a leg support 56 may be movably attached to the seat support 25. The leg support 56 may be bilateral (shown in FIGS. 1 and 2) or unilateral (not shown) and is movable between a stowed position underneath and substantially parallel to the seat support 25, as shown in FIG. 3A, and a support position to support the knees, as shown in FIG. 1. The support position can be configured to support the knees in flexion or in extension. The leg support 56 is mounted to the seat support 25 whereby the leg support 56 can move with the seat support 22, or can pivot relative to the seat support 22. The leg support 56 may be pivotable in increments of a predetermined number of degrees.

The arm supports 58 are pivotably attached to the back support 24, as shown in FIG. 1 for example, but may alternately be pivotably attached to the frame 10 or the seat support 25. The arm supports 58 are movable up and back out of the way for transfers in and out of the chair. The arm supports 58 may be padded for example, by foam.

In the folded position, the back support 26, arm supports 58, and seat support 25 are folded onto one another, as shown in FIG. 3C.

A tilt mechanism is configured to tilt, or rotate, the seat assembly 20 relative to the frame 10. As shown in FIGS. 3A and 3B, the tilt mechanism includes a rod 62 connected at a first end to the frame 10 and connected at a second end to a substantial center of gravity of the seat support 25. Thus, the second end of the rod 62 is located substantially or approximately below a center of gravity while the user is seated in the chair, for most users.

The rod 62 of the tilt mechanism further includes a piston (not shown). A control unit (not shown) may be operatively connected to the piston to control rising and lowering of the piston. The second end of the rod 62 is slidable relative to the seat support 25 in a forward and backward direction.

The seat support 25 and back support 26 are configured to tilt relative to the frame 10. The seat support 25 and back support 26 may be tiltable together up to about 40-45 degrees for adequate pressure relief and to place the user in a resting position. The seat support 25 and back support 26 may tilt together as one unit. The seat support 25 and back support 26 may tilt back and forth up to 45 degrees in increments while maintaining a fixed seat to back angle. The leg support 56 and/or the arm supports 58, and head support 5, if included, may also tilt together with the seat support 25 and back support 26

To recline from an upright position, the user may press an actuating button on the control unit (not shown), which may be located on the seat assembly 20 or on a remote, and shifts his weight in a backward direction. The tilt mechanism will tilt the user until the button is released or until the seat assembly 20 reaches a fully reclined position. To return to the upright position, the user presses the button and shifts the user's weight in a forward direction. Once the seat assembly 20 has reached the desired position, the user releases the button. Thus, the user can tilt the seat support 25 and back support 26 by shifting the center of gravity beyond the point of rotation about the rod 62.

The tilt mechanism provides the ability to change positions for pressure relief and for comfort while maintaining a safe functional posture and decreasing fall risk. This tilt feature aids in maintaining healthy skin integrity and preventing pressure sores that plague wheelchair users. The tilt mechanism also assists in folding the chair.

To fold the chair from the seating position shown in FIG. 3A, the arm rests 58 are folded up to be substantially parallel with the back support 26, and the back support 26 along with the arm supports 58 are rotated downward toward the seat support 25, as shown in FIG. 3B. The leg support 56 is placed in the stowed position under the seat support 25. From the position shown in FIG. 3B, the seat support 25, back support 26, and arm supports 58 tilt relative to the frame 10 in a backward direction, as shown in FIG. 3C. The seat support 25 is rotatable about a pivot 31 located at a front of the seat support 25. In the folded position, a back of the seat support 25 is adjacent to a bottom of the frame 10. According to one aspect, the seat support 25 is pivotable up to an angle of approximately 45 degrees. Thus, the tilting mechanism in combination with the back support 26 being rotatable relative to the seat support 25 allow the chair to fold to a compact size.

FIGS. 4A to 4E illustrate exemplary embodiments of a transfer board assembly 45. The transfer board assembly 45 includes a transfer board 40, which is a rigid plate, and an attachment assembly that attaches the transfer board 40 to the seat assembly 20.

Figure 4A:
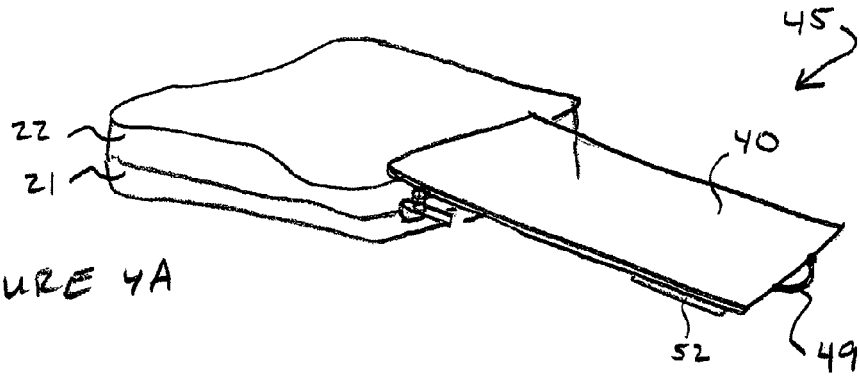
FIG. 4A is a perspective view of an exemplary embodiment of a seat assembly and transfer board assembly illustrating the transfer board assembly in a transfer position.
Figure 4B:
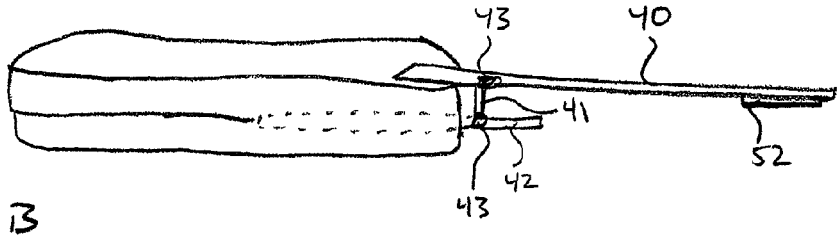
FIG. 4B is a front view of the exemplary embodiment of FIG. 4A.
Figure 4C:
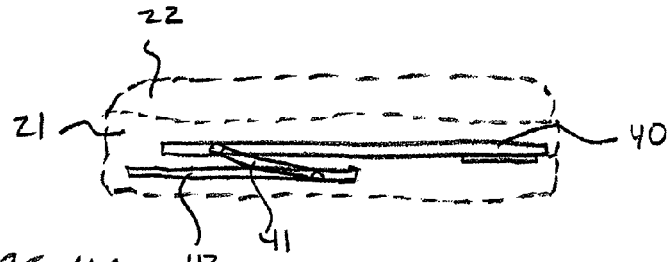
FIG. 4C is a front view of the exemplary embodiment of FIG. 4A illustrating the transfer board assembly in a stowed position.

The transfer board assembly 45 is movable between a first, stowed position, as shown, for example, in FIG. 4C, and a second, transfer position, as shown, for example, in FIGS. 4A and 4B. The transfer board 40 is pivotably attached to an intermediate element 41 as shown in FIGS. 4A-4C. The transfer board 40 may be attached to the intermediate element 41 by one or more hinges. As shown in FIGS. 4A to 4C, the intermediate element 41 may be an intermediate plate. Alternately, the intermediate element 41 may be one or more bars or other element as would be understood by one of skill in the art. The intermediate element 41 is pivotably attached (via one or more hinges or the like) to a lower plate 42. The lower plate 42 is movably attached to the seat assembly 20 via a pocket between the seat cushion 22 and the seat frame 21, as shown in FIGS. 4A-4D.

Figure 4D:
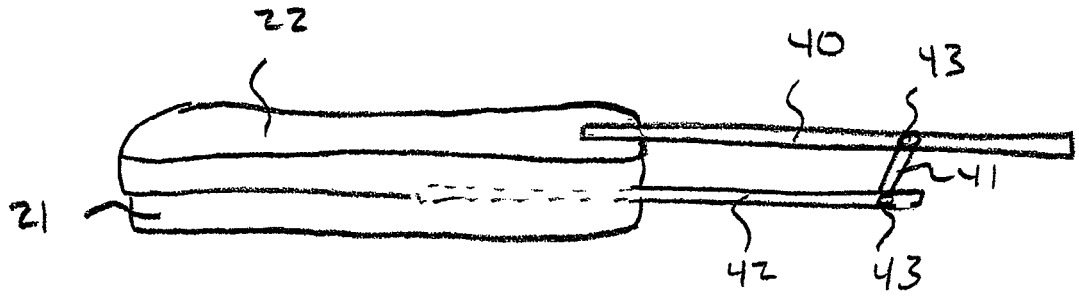
FIG. 4D is a front view of another exemplary embodiment of a seat assembly and transfer board assembly.

As shown in FIGS. 4A and 4B, when the transfer board assembly is in a second, transfer position, one end of the transfer board 40 rests on the seat cushion 22, and an opposite end of the transfer board 40 is free to rest on a secondary surface, such as a chair or bed to which a user is to be transferred. The intermediate element 41 is pivotably attached to the transfer board 40 at a position between the end of the transfer board 40 which rests on the seat cushion 22 and the opposite end of the transfer board 40. As shown in FIGS. 4A and 4B, the intermediate element 41 may be attached to the transfer board 40 adjacent to the end of the transfer board 40 which rests on the seat cushion 22. Alternately, as shown in FIG. 4D, the intermediate element 41 may be attached to the transfer board 40 closer to or at the opposite end of the transfer board 40.

When the transfer board assembly is in the first, stowed position, as shown in FIG. 4C, the transfer board 40, the intermediate element 41 and the lower plate 42 may pivot fold onto each other to be stowed between the seat cushion 22 and the seat frame 21 in a substantially "Z" shape.

From the first, stowed position, the transfer board 40 may be laterally slidable from between the seat cushion 22 and the seat frame 21 into the second, transfer position. The transfer board assembly 45 may be slid out either the right-hand or left-hand side of the seat assembly 20.

The attachment assembly may include a stopping mechanism to prevent the attachment assembly from being completely detached from the chair, as would be understood by one of skill in the art.

Figure 4E:
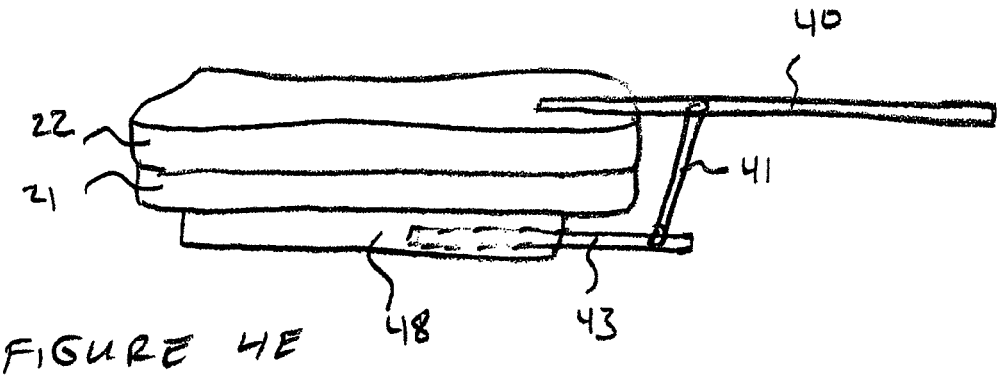
FIG. 4E is a front view of another embodiment of a seat assembly and transfer board assembly.

As shown in FIGS. 4A-4D, the transfer board assembly 45 may be disposed between the seat cushion 22 and the seat frame 21 when in the first, stowed position. Alternately, as shown in FIG. 4E, the transfer board assembly 45 may be stowed in the first position below the seat frame 21 and may be attached to the seat frame by a track 48. The track 48 may also be positioned within the seat support 25, between the seat cushion 22 and the seat frame 21. The track 48 may have two c-shaped grooves which bracket the transfer board assembly 45 when in the first, stowed position or may have another shape as would be understood by one of skill in the art.

The pivotable intermediate element 41 disposed between the transfer board 40 and the lower plate 42, compensates for height variations in the point of transfer and in the seat cushion 22 thickness which may vary due to the weight of the user.

The transfer board assembly 45 may include a knob or handle 49 to allow a user to easily pull the transfer board out from the first position. The transfer board 40 may include a portion 52 that is rougher to prevent the transfer board 40 from slipping off of the secondary surface.

A movable drive handle 64, as shown in FIGS. 1 and 2, is operatively connected, via a rod 65, to the drive wheels 12 through a propulsion mechanism 66 (see FIGS. 5 and 6) to allow the user to input torque to the propulsion mechanism 66 by pushing the drive handle 64. The drive handle 64 may include a release mechanism (not shown) operatively connected to the tilt mechanism 60 to allow the user to control the tilt mechanism 60 through controls on the handle 64. The drive handle 64 may be a pair of bilateral hand levers, as shown in FIGS. 1 and 2. Alternatively, the drive handle may be a single piece extending entirely across the user (not shown).

A push handle 68 may be disposed on the back support 26 whereby a caregiver may push the chair instead of the user propelling the chair manually. Exemplary aspects of the chair may include manual brakes, in a position to be operable either by the user or by a caregiver pushing the chair for safe transfers in and out of the chair.

Figure 5:
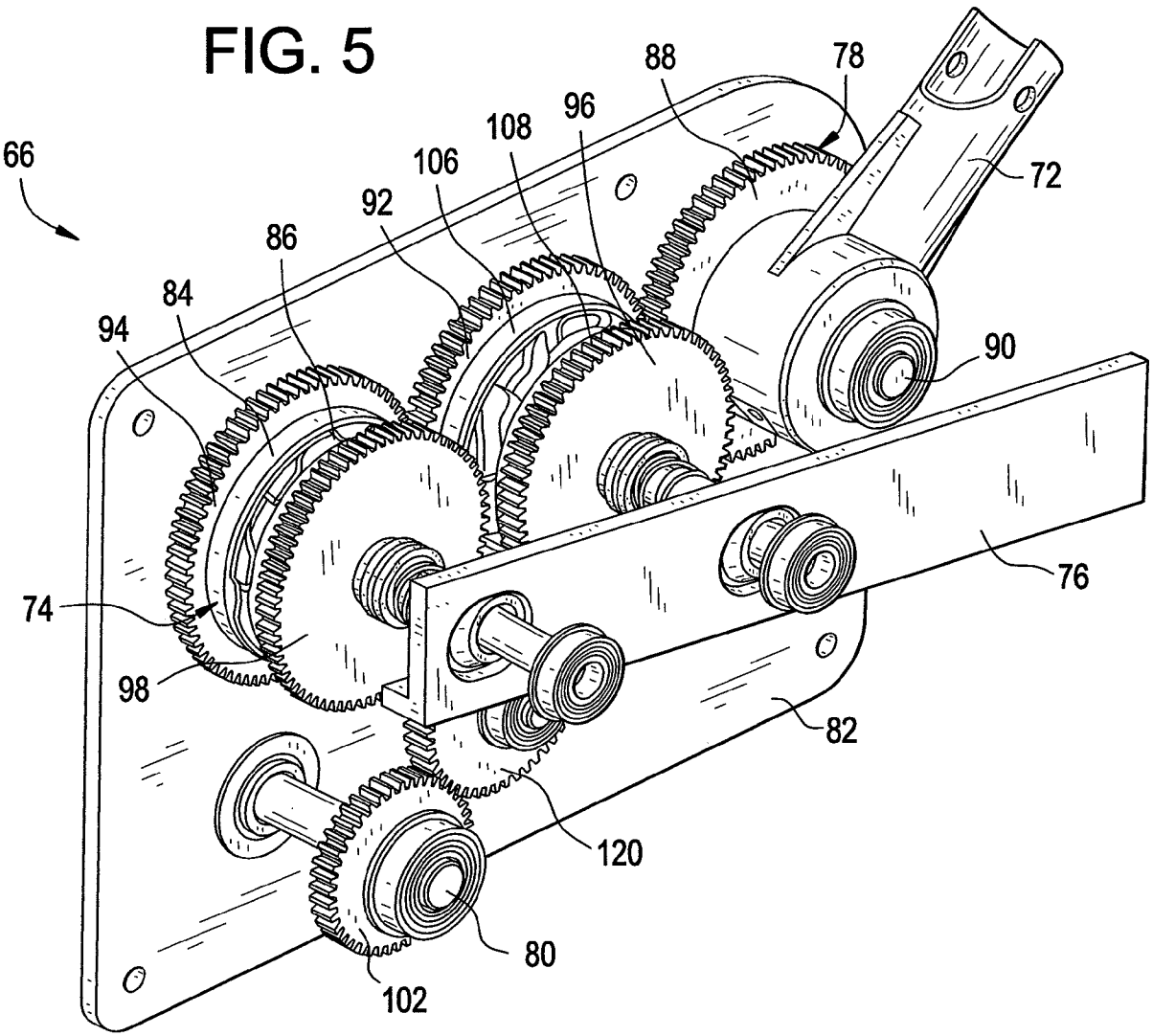
FIG. 5 is a perspective view of an exemplary embodiment of a propulsion mechanism.
Figure 6:
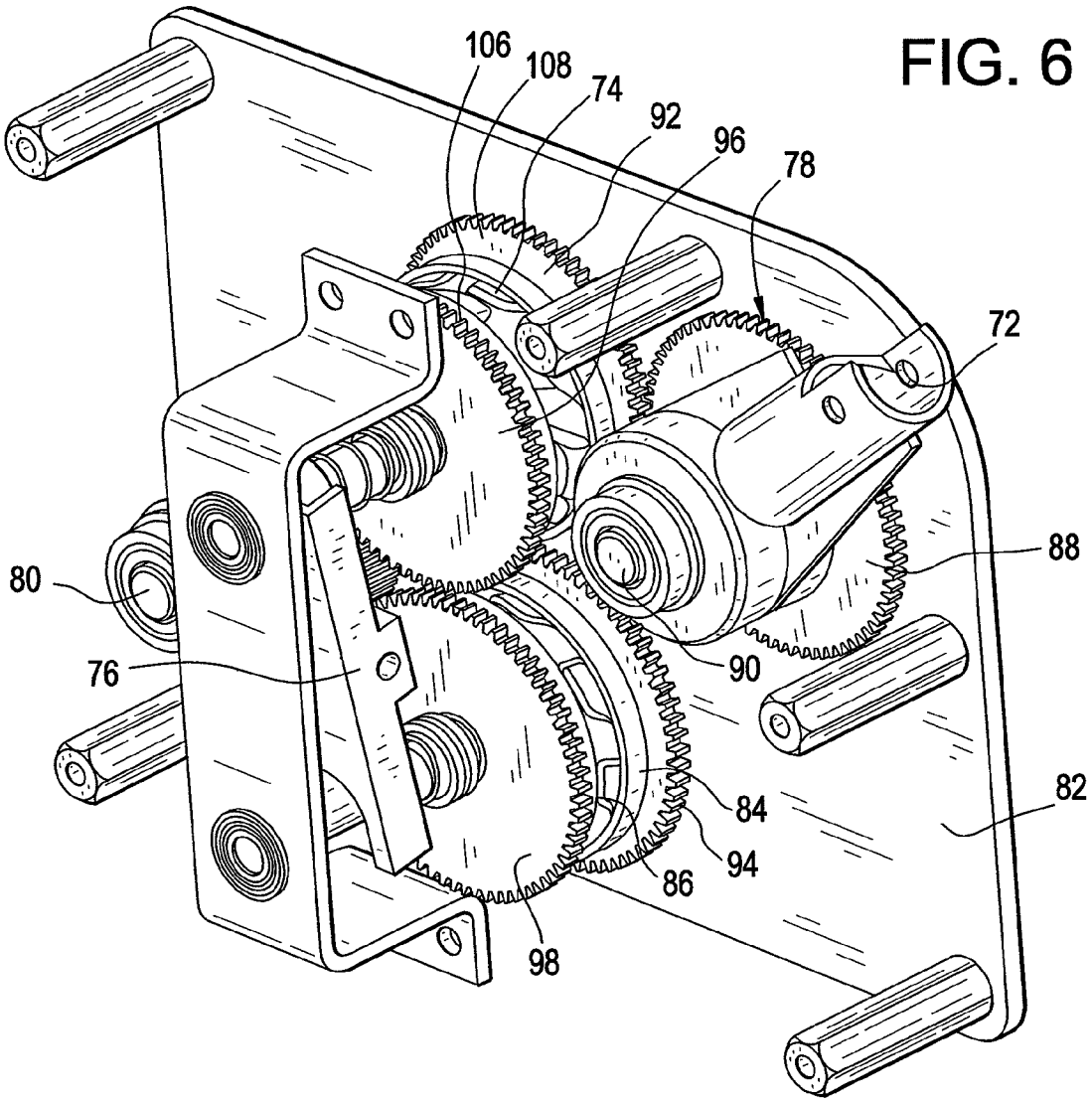
FIG. 6 is a perspective view of another exemplary embodiment of a propulsion mechanism.

As shown in FIGS. 5 and 6, the propulsion mechanism 66 includes an input arm 72 attached to the handle 64 via the rod 65, a clutch system 74, an actuator 76, a gear train 78, an output shaft 80, and a housing 82. The actuator 76 is movable between a first setting in which an output of the actuator 76 is in the same direction as the input, a second setting in which the output of the actuator 76 is in a different direction than the input, and a third setting in which the actuator 76 is in neutral. In the first setting, the chair is movable in a forward direction; in the second setting, the chair is movable in a reverse direction; and in neutral, no power is transferred from the handle 64 to the wheels 12.

To enable forward motion of the chair, the actuator 76 is placed in the first setting, as shown in FIG. 5. In the first setting, the clutch plates 84, 86 engage one another using a spring force. The drive arm 72 is keyed to the input gear 88 on the input shaft 90. The input gear 88 is fully engaged with the gear 92, which in turn is fully engaged with gear 94. Gears 96 and 98 are fully engaged with intermediate gear 120. Intermediate gear 120 is fully engaged with output gear 102 which is connected to the output shaft 80. The output shaft 80 is connected to the wheels 12. When the input gear 88 is rotated clockwise, gear 92 is rotated counterclockwise, rotating gear 94 clockwise. With clutch plates 84, 86 engaged, gear 98 is driven clockwise, but not counterclockwise due to slippage in the clutch plates 84, 86 in the counterclockwise direction. When engaged, the two clutch plates 84, 86 have a function similar to that of a ratchet. Gear 98 rotating clockwise rotates intermediate gear 120 counterclockwise which in turn rotates the output gear 102 and the output shaft 80 clockwise. Thus, the output rotation is the same direction as the input rotation.

To enable reverse motion of the chair, the actuator 76 is placed in the second setting, which engages clutch plates 106, 108. In FIG. 5, to place the actuator 76 is the second setting, the right distal end of the actuator 76 in FIG. 5 would be moved in a backward direction. When the input gear 88 is rotated clockwise, gear 92 is rotated counterclockwise. While this rotates gear 94, without clutch plates 84, 86 engaged, gear 98 rotates freely and has no effect on the system. This is also true of gear 96 in the second setting. With clutch plates 106, 108 engaged, gear 96 is driven counterclockwise, but not clockwise due to slippage in the clutch plates 106, 108 in the clockwise direction, Gear 96 rotating counterclockwise rotates intermediate gear 120 clockwise which, in turn, rotates the output gear 102 and the output shaft 80 counterclockwise, Thus, the output rotation is the reverse direction as the input rotation.

To disengage the propulsion mechanism 66, the actuator 76 is placed in the third position, i.e., the neutral position, between the first and second position. In the third position, the forward drive clutch plates 84, 86 are disengaged from another and the reverse drive clutch plates 106, 108 are disengaged from one another. Without either pair of clutch plates engaged, the input shaft 90 rotates independently of the output shaft 80.

The combination of the input arm 72 and the rod 65 is long so that the user generates a substantial mount of torque with a minimal amount of force. The length of the input arm 72 and the rod 65 is great enough to provide more than sufficient torque to move the chair with an occupant seating therein. The gear train 78 uses the access torque to generate more speed and therefore a greater distance is traveled by the chair with every push of the input arm 72. The length of the input arm 72 and the rod 65 can be modified to meet the needs of the user.

Both handles 64 shown in FIG. 1 can move together for propulsion forward, the right handle 64 can be pushed individually to turn to the left and the left handle 64 can be pushed individually to turn to the right.

Figure 7:
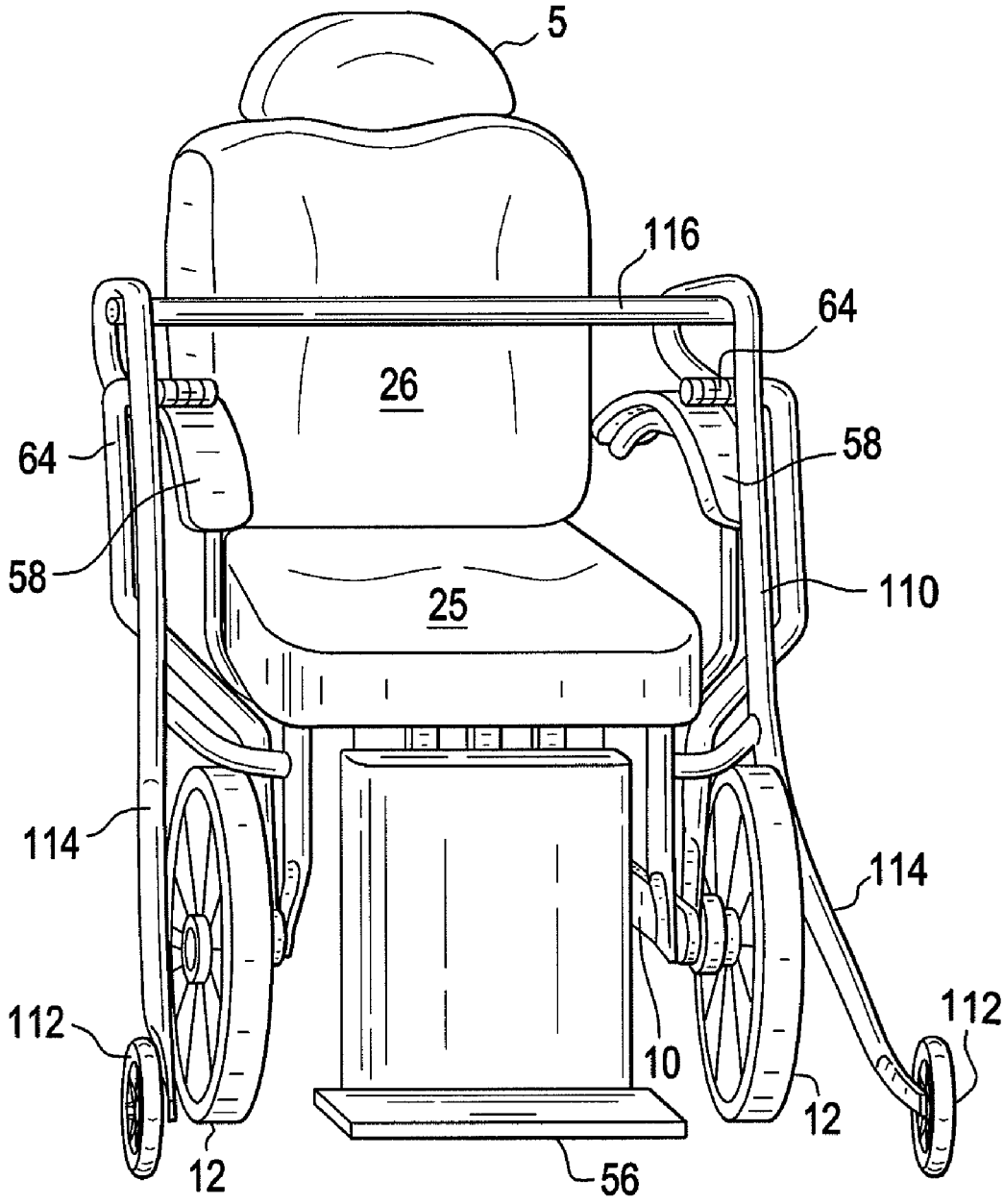
FIG. 7 is a perspective view of an exemplary embodiment of the invention illustrating a detachable walker.

A walker 110, as shown in FIG. 7, may be removably attached to the frame 10 for easy transport by caregivers. The walker 110 includes a pair of walker wheels 112 rotatably supported by a pair of legs 114, and a gripping bar 116 interconnecting the two legs 114. The pair of legs 114 are disposed a distance apart from one another that is greater than a width of the seat support 25 and greater than a distance between the outer edges of the arm supports 58. Thus, the walker 110 can be attached to the frame 10 about the user while the user is seated in the chair. The user can then use the walker 110 to assist the user in standing up and walking with the chair. The walker 110 can also be detached from the chair.

A detachable seat cover may be disposed on the seat cushion 22 to assist a caregiver with repositioning the user in the chair or to assist with transfers without harming the users or themselves. The seat cover may include a fastener, such as a hook and loop fastener that attaches to the sides of the seat. The seat cover may be used as a repositioning device or a transfer assist device so that caregivers do not have to pull on the user's body parts during these maneuvers.

The exemplary embodiments may also provide a comfortable, contoured solid seat cushion 22, back cushion 27, and one-piece leg support 56 made with pressure relieving memory foam that can conform to individual's body structures and help prevent pressure ulcers on the boney prominences. Exemplary embodiments of the chair may be designed ergonomically to accommodate normal spinal curves and pelvic stability. Exemplary embodiments of the chair may be light weight and foldable for transport out into the community. Exemplary embodiments may accommodate individuals with knee flexion contractures such that their legs do not extend to a 90 degree position but must bend further underneath the seat cushion 22. Exemplary embodiments may prevent the user from falling out of the chair and prevents pressure areas behind the legs or ankles. The leg support 56 may also extend forward to accommodate extensor contractures or for edema management of the lower extremities. Exemplary embodiments may be particularly helpful for those individuals with limited mobility, compromised cardiac, respiratory, or swallowing function, fragile skin integrity, potential for contractures, and overall generalized weakness and low activity tolerance.

Although the above exemplary embodiments have been described, they are not limiting, and it will be understood by those skilled in the art that the present invention should not be limited to the described exemplary aspects and embodiments, but that various changes and modifications can be made within the spirit and scope of the present invention.

What is claimed is:

1. A mobile chair assembly comprising:

a frame;

a plurality of wheels rotatably supported by the frame;

a seat assembly mounted to the frame, comprising a seat cushion; and a transfer board assembly attached to the seat assembly and movable between a first position and a second position, the transfer board assembly comprising a rigid transfer board and an attachment assembly, wherein the attachment assembly comprises a lower rigid plate and an intermediate element, wherein a first end of the intermediate element is pivotably attached to a lower surface of the transfer board and a second end of the intermediate element is pivotably attached to an upper surface of the lower rigid plate, the lower rigid plate being slidably attached to the seat assembly;

wherein in the first position, the rigid transfer board and the attachment assembly are disposed under the seat cushion and in the second position, the rigid transfer board extends laterally from the seat cushion.

2. The mobile chair assembly of claim 1, further comprising a handle attached to the transfer board.

3. The mobile chair assembly of claim 1, wherein the attachment assembly further comprises a track attached to the seat assembly and the lower rigid plate is slidably attached to the track.

4. The mobile chair assembly according to claim 1 wherein, in the first position the transfer board is disposed substantially on top of the intermediate element and the intermediate element is disposed substantially on top of the lower rigid plate.

5. The mobile chair assembly according to claim 1, wherein, in the second position, one end of a transfer board rests on the seat assembly, and the lower rigid plate is substantially parallel to the transfer board.

6. The mobile chair assembly of claim 1, wherein the seat assembly comprises the seat cushion and a seat frame, and in the first position the transfer board assembly is disposed between the seat cushion and the seat frame.

7. The mobile chair assembly of claim 1, wherein a portion of the transfer board is rougher than a remainder of the transfer board.

8. The mobile chair assembly of claim 1, wherein the attachment assembly further comprises a pair of parallel grooves attached to the seat assembly, and the lower rigid plate is slidably attached to the pair of parallel grooves.

* * * * *